United States Patent [19]

Reynolds

[11] 4,290,532

[45] Sep. 22, 1981

[54] SUPPORT ASSEMBLY

[76] Inventor: Lawrence E. Reynolds, 1169 Garden Dr., New Port Richey, Fla. 33552

[21] Appl. No.: 75,807

[22] Filed: Sep. 14, 1979

[51] Int. Cl.[3] ..... A47F 5/00

[52] U.S. Cl. ..... 211/200; 211/203; 211/119.01

[58] Field of Search ..... 211/200, 203, 204, 207, 211/208, 119.01; 248/653, 164, 460; 218/353, 354 R

[56] References Cited

U.S. PATENT DOCUMENTS

| | | | |
|---|---|---|---|
| 2,481,577 | 9/1949 | De Puy | 248/164 X |
| 2,558,410 | 6/1951 | Andersen | 211/119.01 |
| 2,638,231 | 5/1953 | Tardie et al. | 211/119.01 |
| 2,744,712 | 5/1956 | Brandt | 248/460 X |
| 3,685,824 | 8/1972 | Quinn | 248/164 X |
| 3,767,149 | 10/1973 | Hill | 248/164 X |
| 4,131,205 | 12/1978 | Malecki | 211/200 |

FOREIGN PATENT DOCUMENTS

| | | | |
|---|---|---|---|
| 1058721 | 2/1967 | United Kingdom | 211/119.01 |

*Primary Examiner*—Roy D. Frazier
*Assistant Examiner*—Robert W. Gibson, Jr.
*Attorney, Agent, or Firm*—Arthur W. Fisher, III

[57] ABSTRACT

A support assembly primarily designed to support clothes lines in an attended fashion and generally between the primary or permanent supports located at opposite ends of the clothes lines. A line engaging support bar includes a plurality of line attachment means which supportingly engage each of a plurality of parallel arranged lines wherein the support bar is disposed in a supported fashion by two support elements pivotally interconnected to one another wherein each of the elements are structured to have the longitudinal dimension variable which in turn allows variance of the height of the support assembly and accordingly the amount of support offered to the plurality of clothes lines and causing an adjustable variance in the space between the clothes lines and the ground or other surface.

1 Claim, 4 Drawing Figures

SUPPORT ASSEMBLY

BACKGROUND OF THE INVENTION

1. Field of the Invention

A clothes line supporter specifically structured to support in a supplementary fashion a plurality of parallel arranged clothes line by movably attached and adjustably positioned support elements wherein the overall height of the support assembly may be varied in accordance with the support required.

2. Description of the Prior Art

The drying of clothes, cloth, and similar type articles are clothes lines by exposure to the suns radiant energy has long been a popular and useful practice. In current time such practices have been returned to rather than utilizing automatic and electrically powered clothes dryer due to the intent and demand for energy saving devices. In addition such energy conservation is specifically encouraged when equivalent practices can be conducted through the use of abundant radiant energy rather than electricity which ultimately utilizes fossil fuel through the increased use of electricity.

Typically the support for clothes line incorporates at least two and frequently a plurality of permanently installed poles having a T-shaped cross bar located at one end thereof which are permanently affixed in the ground or other surface on which the entire clothes line assembly is mounted. Due to the fact that wet clothes or the cloth material being dried can be extremely heavy supplementary support facilities are frequently required to bolster the clothes line when ladened with the wet clothes thereon. This is particularly true when the length or runs of the clothes lines are extended beyond more than a few feet.

Typically such supplementary devices merely included a plurality of elongated poles or like structural element having a V-shape cut out portion at one end thereof for the engagement of individual clothes lines. The opposite end of the support pole would merely be wedged into the ground.

Obvious disadvantages occur with the use of such devices. Such disadvantages include disruption or over turning of the structure during high or even mederate winds. This of course dirties the wet clothes and defeats the entire purpose of using outdoor facilities for drying.

Other supplementary support devices are existing in the prior art and are commercially available. These devices are generally represented by the structures disclosed in the following U.S. Pat. Nos.: 96,183; 1,059,921; 1,061,851; 1,164,138; 1,332,323; 2,734,640; 3,145,965; 323,044.

While the above structures are operable in their specifically intended application, devices of this type frequently suffer from the problem of being overly complex and therefore too expensive to purchase and/or maintain.

Accordingly, there is a need for a supplementary support facility capable of augmenting the support supplied by permanently installed clothes line pole wherein such a support assembly may support a plurality of lines and may be adjustable along its longitudinal axis to vary the degree of support offered as well as the overall height between the ground and the clothes lines on which wet clothes may be attached.

SUMMARY OF THE INVENTION

The present invention is directed towards a supplementary support assembly of the type specifically designed to support a plurality of clothes lines which are arranged in spaced apart relation to one another and which are intended to have numerous clothing or cloth like articles mounted thereon for exposure to the sun's radiant energy.

The support assembly of the present invention comprises a line engaging means including, in the preferred embodiment a cross bar with a plurality of line attachment elements defined by apertures formed therein. The line attachment apertures are disposed in spaced apart relation to one another and are configured to totally surround each of the individual clothes line in a sliding fashion. This enables the cross bar, and the entire assembly, as will be explained in greater detail hereinafter, the displacement of the assembly along the length or run of the clothes lines between permanently installed supporting poles. A mounting means is disposed in supporting engagement with the line engaging cross bar and is specifically structured so as to vary the overall longitudinal dimension of the mounting means and thereby vary the height between the ground and the cross bar for in turn varying the amount of support offered to the plurality of clothes lines.

The mounting means, preferably comprises a plurality and at least two support elements pivotally attached to one another at a point along their mutual length so as to allow pivotal movement therebetween. Such pivotal movement again causes an overall variance in the longitudinal dimension of the mounting means itself and may vary the height of the cross bar line engaging element from the ground on which the entire assembly is positioned.

In addition, each of the two support elements is defined by two segments. Each segment is movable relative to one another along a common longitudinal axis wherein the longitudinal dimension of each support element may be varied through relative movement or positioning of the two segments defining each of the support elements. A locking element in the form of a key or bolt is disposed in interruptive engagement with both of the segments defining a single support element to prevent relative movement therebetween. This in turn will at least temporarily define an overall longitudinal dimension of each of the support elements.

It can therefore readily be seen that the overall dimensions or height of the entire mounting means may be varied either through pivotal movement of the two interconnected support elements or by varying the longitudinal dimension of a single support element through relative positioning of the two segments which comprises the individual support element.

Accordingly, utilization of the supplementary support assembly the present invention permits the efficient supplementary support of the pluarlity of clothes lines at any point along the run of the clothes line wherein the assembly is capable of providing varying degrees of support through positioning of the clothes line at various points or space distances from the ground on which the entire assembly is positioned.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawing in which.

Similar reference characters refer to similar parts throughout the several views of the drawings.

DETAILED DESCRIPTION OF THE PREFERRED EMBODIMENT

Figure 1:
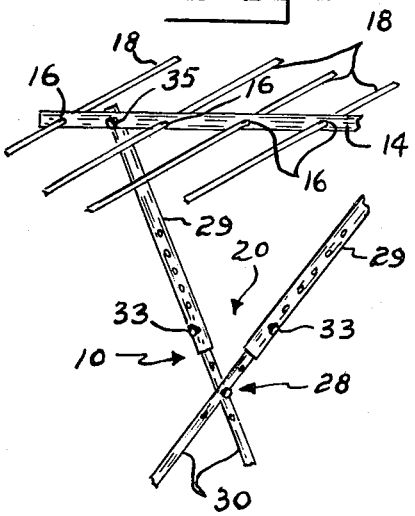
FIG. 1 is a perspective view showing the supplementary support assembly of the present invention in operative position.

As shown in FIGS. 1 through 4 the supplementary support assembly of the present invention is generally indicated as 10 and includes a line engaging means generally indicated as 12 defined by an elongated, supporting cross bar element 14. The plurality of attachment elements are formed in the cross bar 14 and are defined, in the preferred embodiment, by a plurality of apertures 16. Each of the apertures are disposed in spaced apart relation to one another and integrally formed in the cross bar 14. Further, the apertures 16 are dimensioned and structured as to be disposed in surrounding relation to the individual clothes line 18 (FIG. 1). Sliding engagement of the cross bar 14 is thereby provided along the length of the plurality of clothes lines 18 due to the surrounding, sliding arrangement of each of the apertures 16 relative to the individual clothes line 18. Accordingly each of the clothes line 18 is supported in sliding engagement on the interior and in surrounded relationship by one of the apertures 16.

Figure 4:
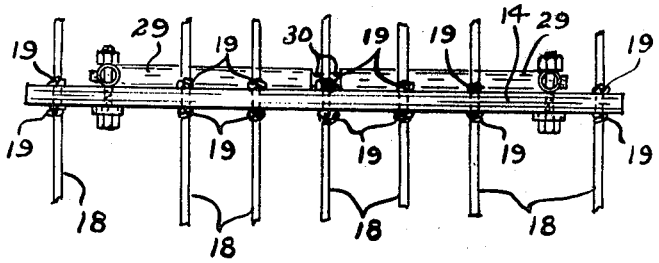
FIG. 4 is a top view of the embodiment of FIG. 2 showing the supported clothes lines in partial cutaway.

However, with regard to the embodiment of FIG. 4 knots or other obstructions may be disposed in the length of the clothes lines 18 as at 19 on opposite sides of the cross bar 14 so as to restrict sliding engagement of the cross bar 14 along the length of the run of the plurality of clothes line.

The supplementary support assembly of the present invention further comprises a mounting means generally indicated as 20 interconnected at one end to the cross bar 14 which will be explained in greater detail hereinafter and the opposite end mounted on the ground or other supporting surface 22 on which the entire assembly is positioned. More specifically the mounting means comprises a plurality, and preferably two support elements 24 pivotally connected as at pin 28 such that the space between the opposite ends may be varied in order to vary and/or change the overall longitudinal dimension of the mounting means 20 and accordingly the height of the cross bar 14 from the supporting ground 22.

Figure 2:
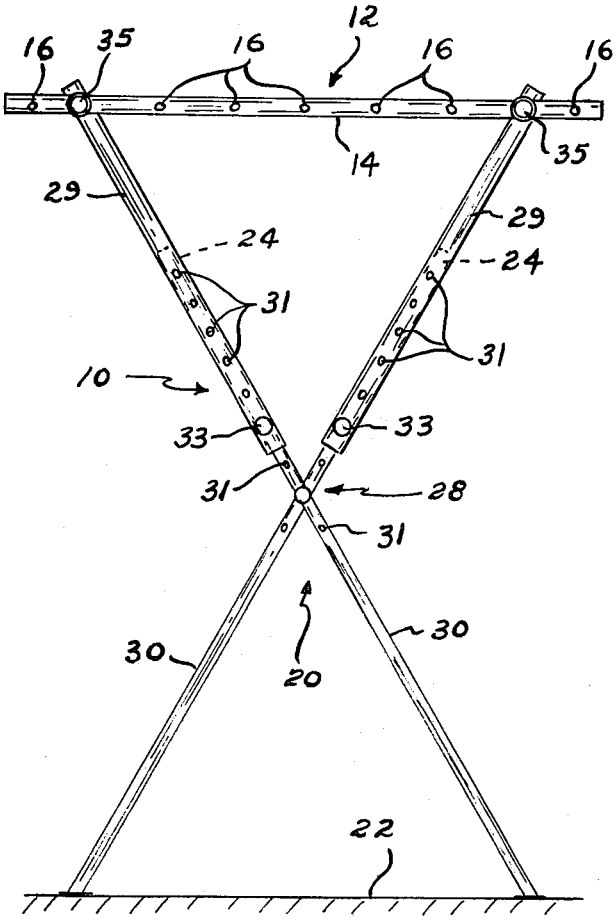
FIG. 2 is a front plane view of the assembly.
Figure 3:
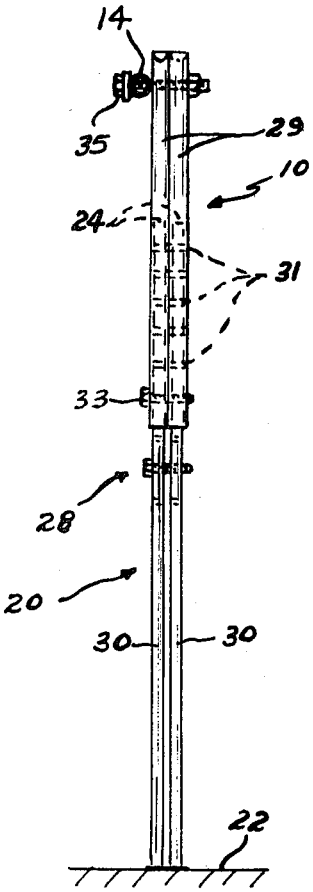
FIG. 3 is a side view of the embodiment of FIG. 1.

Each of the support elements 24 is defined by at least two segments 29 and 30. Each of the segments 29 and 30 comprising each of the separate support elements 24 are movable relative to one another in a direction corresponding to the longitudinal axis of the support element 24. In one embodiment the two segments may be arranged in telescoping relationship to one another (FIGS. 2 and 3). Alternatively they may be attached in immediate, side by side relationship to one another and movable again along the length of one another to vary the overall longitudinal dimension thereof. The interconnecting means comprising a plurality of holes 31 are disposed in spaced apart relationship to one another along the length of both segments 29 and 30. A locking bolt or pin 31 is disposed through both the apertures 33 and the individual segments 29 and 30 in interruptive relation to both of the segments so as to prevent relative movement thereof. In this manner the overall length of the support elements 24 or may be varied and/or maintained to also regulate the overall height of the assembly and the distance from the ground 22 to the cross bar 14.

The opposite end of each support element 24 is secured by an additional connector or bolt element 35 extending through one of the apertures 16 normally filled by the clothes line 18.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A supplementary support assembly of the type primarily designed to simultaneously support a plurality of clothes lines, said support assembly comprising: line engaging means disposed in supporting attachment with a plurality of parallel clothes lines comprising a substantially elongated bar element disposed in concurrent supporting engagement with the plurality of parallel clothes lines and oriented in substantially transverse relation to the longitudinal run of the plurality of clothes line, line attachment means formed on said elongated bar element and comprising a plurality of attachment elements, wherein each of the plurality of parallel clothes lines supported by said elongated bar element is in engageable relation with one of said attachment elements, said plurality of attachment elements comprise a plurality of apertures, each of said apertures is integrally formed in said elongated bar element in spaced apart relation to one another, each said plurality of apertures each disposed in surrounded disposition to one of the parallel clothes line, mounting means connected in supporting engagement with said line engaging means and disposed in interconnected relation between the ground and said line engaging means, said mounting means comprising at least two support elements, each said support element comprising two segments disposed in telescoping relationship relative to each other, each of said two segments including a plurality of apertures formed along the length thereof, corresponding segments of each of said two support elements being pivotally coupled by a pin extending through any corresponding said apertures of said corresponding segments, said two segments of each said two support elements being disposed in longitudinally movable relation relative to each other along the direction of the longitudinal axis of each said support element, each said support element varied in longitudinal dimension upon varying the position of said respective two segments, said corresponding segments being selectively locked relative to each other by pins extending through any corresponding said apertures, the upper portion of each said support element being coupled to said line engaging means by a pin extending through any one of said aperture formed on said elongated bar element such that the distance between said coupling is selectively varied, whereby the space between said line engaging means and the ground is varied upon selectively adjusting said longitudinal dimension, said pin extending through any of said corresponding aperture of said corresponding segments and said pins extending through any one of said aperture formed on said elongated bar element.

* * * * *